United States Patent [19]

Mott

[11] 3,938,589

[45] Feb. 17, 1976

[54] DRILLING TOOL

[75] Inventor: James D. Mott, Houston, Tex.

[73] Assignee: Hydril Company, Houston, Tex.

[22] Filed: Oct. 3, 1973

[21] Appl. No.: 403,204

Related U.S. Application Data

[62] Division of Ser. No. 201,878, Nov. 24, 1971, Pat. No. 3,783,942.

[52] U.S. Cl. ..... 166/224 A; 175/242

[51] Int. Cl.[2] ..... E21B 43/12; F16K 17/00

[58] Field of Search ..... 166/224, 224 A; 137/496, 137/384.8, 469, 516.29; 175/317, 318, 242, 237

[56] References Cited

UNITED STATES PATENTS

| | | | |
|---|---|---|---|
| 2,874,718 | 2/1959 | Kelly | 137/469 |
| 3,035,808 | 5/1962 | Knox | 166/224 A |
| 3,200,837 | 8/1965 | Brown | 166/224 A |
| 3,605,793 | 9/1971 | Kinsel | 137/516.29 |
| 3,667,557 | 6/1972 | Todd | 175/38 |
| 3,696,868 | 10/1972 | Taylor, Jr. | 166/224 A |
| 3,741,249 | 6/1973 | Leutwyler | 166/224 A |

*Primary Examiner*—Ernest R. Purser
*Attorney, Agent, or Firm*—Pravel & Wilson

[57] ABSTRACT

A drilling tool connected in a drilling string includes a pressure responsive rotatable ball valve for enabling drilling fluid flow down the bore of a drill string which automatically rotates closed for blocking flow through the bore of the drill string when incipient pressure conditions indicate the direction of flow through the bore may be reversed. Means for releasably locking the ball in the open position in response to a preselected directional pressure to enable the running of other tools and the like through the bore of the drilling string are provided. The drilling tool may be employed for controlling an undesired flowing stream of fluid from the bore of the drilling string by stabbing the tool to connect with the drilling string utilizing a stabbing member which is removed after connecting to enable the ball valve to rotate closed to control the flowing stream.

18 Claims, 8 Drawing Figures

22
60g
60i
25a
61a
61
60
83
60a
81b
81a
60f
60e
81c
81h
81i
81
81g
81j
82i
60b
80
81f
82a
20
82g
81d
62
70
25b
60c
81e
82b
71
60d
82f
82
82e
82c
25
24
25c
84
45
25d
82d
41j
45b
41e
41d
35
45a
31a
35a
35b
31
10
41b
40
32
31b
41a
31c
34a
41c
34
30
25e
41
36
40
41
36
37
20
42b
43a
41g
43
41f
24
41i
41h
48
42
46c
46d
46a
46
46b
25f
25n
26
25g
25h
25i
47
25j
47a
42a
50a
25k
50
50b
50c
25m
21
40
33

DRILLING TOOL

This is a division of application Ser. No. 201,878 filed Nov. 24, 1971, now U.S. Pat. No. 3,783,942.

BACKGROUND OF THE INVENTION

This invention relates to the field of a new and improved inside blowout preventor.

Use of back pressure or check valves connected in a drilling string to automatically control well blowouts inside the pipe or drill string has previously been undesirable during drilling operations because of the tendency to restrict the flow of circulating drilling fluid and to interfere with the running of other well tools through the bore of the drill string. These valves operated in response to the pressure in the bore of the drilling string which required that the drilling string be filled with drilling fluid from above the valve as the drill string was lowered into the drill hole increasing nonproductive trip time. When dsed in continuous drilling operations these valves also tended to be eroded or otherwise worn or damaged by the circulating drilling fluid wherein they were often rendered inoperable to block flow up the bore of the drill string when required to do so. This problem of reliability was especially true of the inside blowout preventers that were initially stabbed into the drill string to control an existing blowout flow and were not removed until after the well pressure was controlled by establishing circulation of denser drilling fluid.

SUMMARY OF THE INVENTION

This invention relates to a new and improved inside blowout preventer.

The drilling tool includes a tubular member adapted for connection in a drilling string having a bore therethrough for communicating with the bore of the drill string. A rotatable ball type valve is movably disposed in the bore of the tubular member for automatically controlling the flow of circulating drilling fluid through the bore of the drill string in response to movement of a pressure responsive piston means. The ball is rotated open when the pressure in the bore of the tool for enabling the desired flow through the bore exceeds the well pressure adjacent the drilling tool by a predetermined value. A means for urging keeps the ball rotated closed until existence of the desired flow pressure conditions. A releasable locking means utilizing preselected directional pressure in the bore of the tubular member locks the ball in the open position to enable the running of other tools through the bore of the drilling tool if desired. The ball may also be releasably locked open by a stabbing member for enabling a stabbing connection of the drilling tool in a drill string having an upwardly flow therethrough for controlling the flow from the drill string.

Another object of the present invention is to provide a new and improved inside blowout preventer.

Yet still another object of the present invention is to provide a new and improved pressure responsive inside blowout preventer.

DESCRIPTION OF THE PREFERRED EMBODIMENT

Figures 1A, 1B:
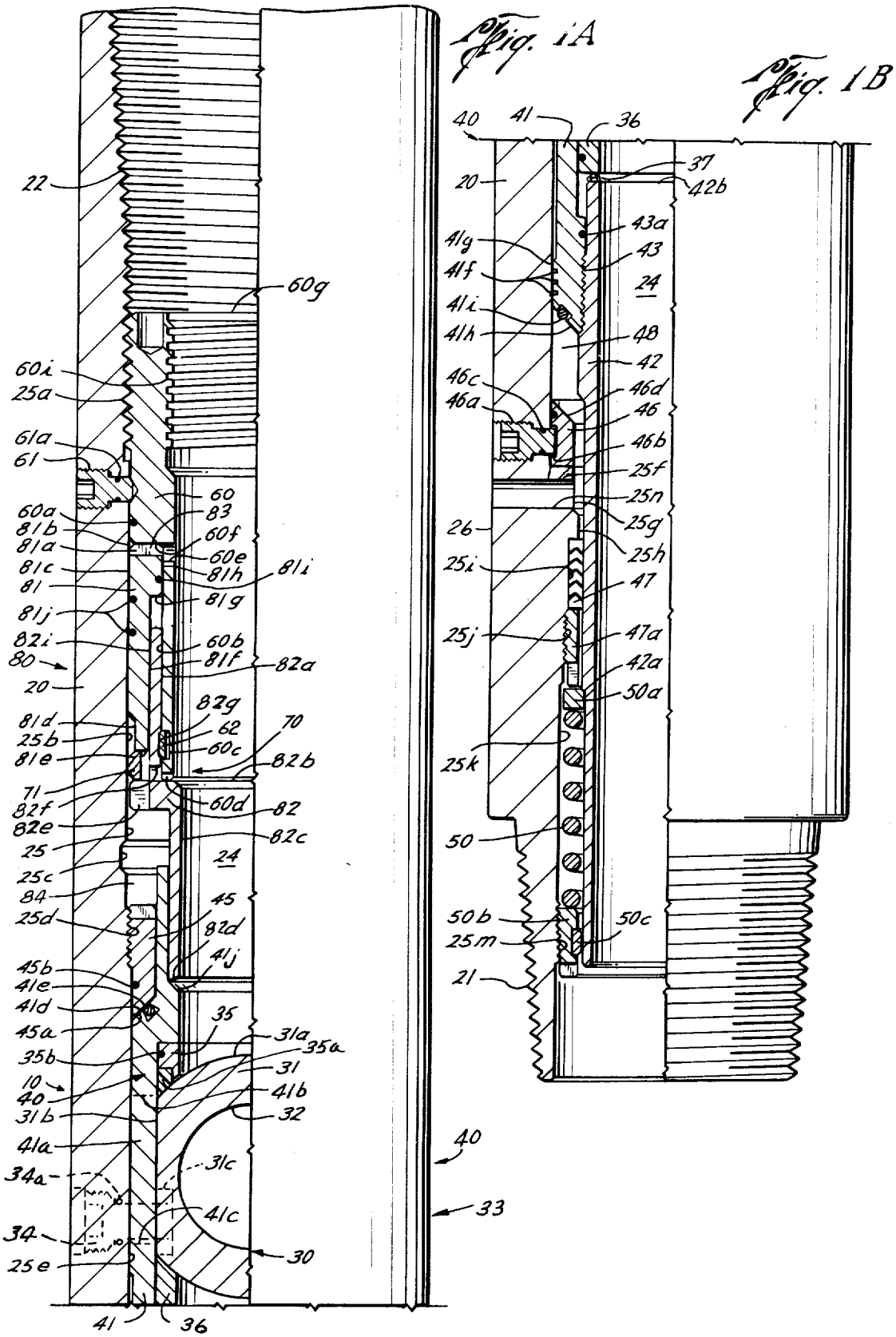
FIGS. 1A and 1B are side views, partially in section, illustrating the drilling tool of the present invention in the closed position.

Attention is directed to FIGS. 1A and 1B where the drilling tool of the present invention is generally designated 10. When connected in a drilling string the tool 10 enables desired circulating flow of drilling fluid down the bore of the drill string to a drill bit. When a well blowout occurs which reverses the direction of flow through the bore of the drill string the tool 10 will block flow through the bore of the drill string.

As illustrated in FIGS. 1A and 1B, the drilling tool 10 of the present invention includes a tubular member or flow control housing 20 which is connected in the drilling string (not illustrated) to form a portion thereof. The tubular member 20 has a threaded pin connection 21 at the lower end for connecting the tubular member 20 with a portion of the drilling string below the drilling tool 10 and a threaded box connection 22 at the upper end for connecting with a portion of the drilling string above the drilling tool 10.

The tubular member 20 has longitudinal bore 24 extending therethrough which is aligned with and communicates with the bore (not illustrated) of the drill string. The bore 24 provides a flow passage for enabling circulation of drilling fluid down the bore of the drill string through the drilling tool 10 to the ports of a drill bit as is well known in the art. The bore 24 is formed by an inner surface 25 of the tubular member 20 which is defined in greater detail, commencing from the box connection 22 by a threaded portion **25*a*, a constant diameter portion 25*b* having a locking recess 25*c* therein, a threaded portion 25*d*, a constant diameter portion 25*e*, a lower annular limit shoulder 25*f*, a vent portion 25*g*, a seal portion 25*h* having a recess 25*i* therein, a threaded portion 25*j* and a constant diameter portion 25*k* having a rasied threaded portion 25*m*. The tubular member 20 has a flow channel vent opening 25*n* formed therethrough adjacent the constant diameter vent portion 25*g* to enable communication between the well annulus area adjacent an exterior surface 26 of the tubular member 20 and the bore 24.**

Disposed in the bore 24 adjacent the constant diameter surface **25*e* is a movable bore closure means designated 30. The bore closure means 30 includes a ball member 31 having a bore 32 therethrough for enabling flow when aligned with the bore 24 of the tubular member 20 and a pivot means 33 for imparting rotation to the ball 31 when the ball 31 is moved longitudinally in the bore 24. The ball 31 is movable from a transverse or closed position (FIG. 1) blocking flow through the bore 24 of the tubular member 20 to an aligned or open position (FIG. 2) enabling flow of fluid through the bore 24 of the tubular member 20. The ball member 31 includes an outer spherical surface 31*a* having a pair of circular parallel flat portions 31*b* with each of the flat portions 31*b*** having an elongated radial extending recess 31*c* formed therein for imparting rotational movement to the ball 31. The pivot means 33 includes a pair of corresponding pins 34 threadedly secured with the tubular member 20 for ease of assembly, at an eccentric location and extending within the corresponding recess 31*c* to rotate the ball 31 when the ball 31 moves longitudinally in the bore 24. The pins 34 carry an O-ring 34*a* to seal the pin 34 to the tubular member 20 to block leakage of fluid therebetween.

The drilling tool 10 includes a pressure responsive piston means 40 operably connected with the ball 31 for effecting movement of the ball 31 to and from the open and closed positions. The piston means 40 is disposed in the bore 24 for moving longitudinally between an upper position rotating the ball 31 closed, illustrated in FIGS. 1A and 1B, and a lower position rotating the ball 31 open, illustrated in FIGS. 2A and 2B, in response to urgings thereon. The piston means 40 preferably includes an upper sleeve member 41 and a lower sleeve member 42 threadedly secured together at 43 (FIG. 1B) for ease of assembly. The piston sleeve 41 is concentrically positioned between the ball 31 and the tubular member 20 adjacent the constant diameter inner surface portion 25*e* of the tubular member 20. The piston sleeve 41 has a pair of longitudinal slots or windows 41*a* formed through the sleeve 41 to provide longitudinal movement enabling clearance to the piston sleeve 41 about the fixed pivot pins 34 extending into the recesses 31*c* in the ball 31. The slots 41*a* have an upper and lower end surface 41*b* and 41*c*, respectively, defining the length of the slot 41*a*. The piston sleeve 41 mounts thereon a portion of the bore closure means 30 including a seat ring 35 mounted concentrically above the ball 31 and having a replaceable seating element 35*a* which engages the spherical surface 31*a* of the ball 31 for blocking flow of fluid upwardly through the bore 24 about the outer surface 31*a* of the ball 31. The seat ring 35 has an O-ring 35*b* to seal between the annular seat ring 32 and the piston sleeve 41 for blocking the passage of fluid therebetween.

The piston means 40 includes a movement upper limit stop means comprising a stop ring 45 threadedly secured to the tubular member 20 by threads 25*d* for engaging the sleeve 41 in the upper position with a downwardly facing tapered annular shoulder surface 45*a*. The stop ring 45 has an O-ring 45*b* to seal the stop ring 45 to the surface 25*e* of the tubular member 20 to block leakage of fluid therebetween. The sleeve 41 engages the ring 45 with a corresponding upwardly facing tapered annular shoulder surface 41*d* and seals thereto in the upper position with an O-ring 41*e* carried on the surface 41*d* to block passage of fluid between the ring 45 and the piston sleeve 41. The sleeve 41 has a plurality of annular labyrinth sealing openings 41*f* formed in a sleeve guide collar 41*g* for limiting the passage of fluid between the piston 41 and the surface 25*e* of the tubular member 20 when the piston sleeve 41 moves to and from the upper and lower positions.

Figure 2A:
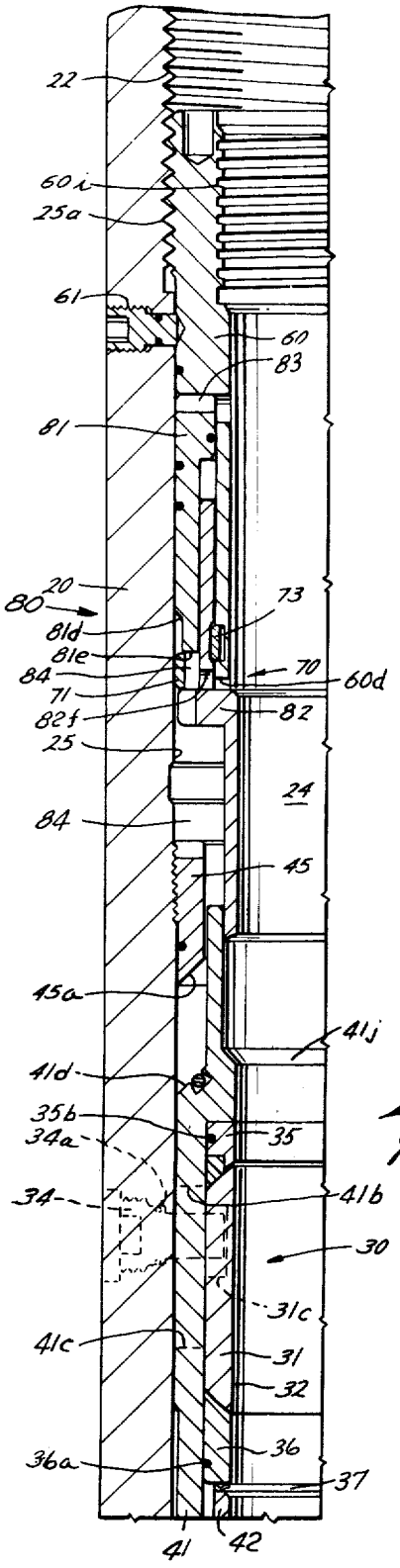
FIGS. 2A and 2B are views, similar to FIGS. 1A and 1B respectively, illustrating the drilling tool in the open position.
Figure 2B:
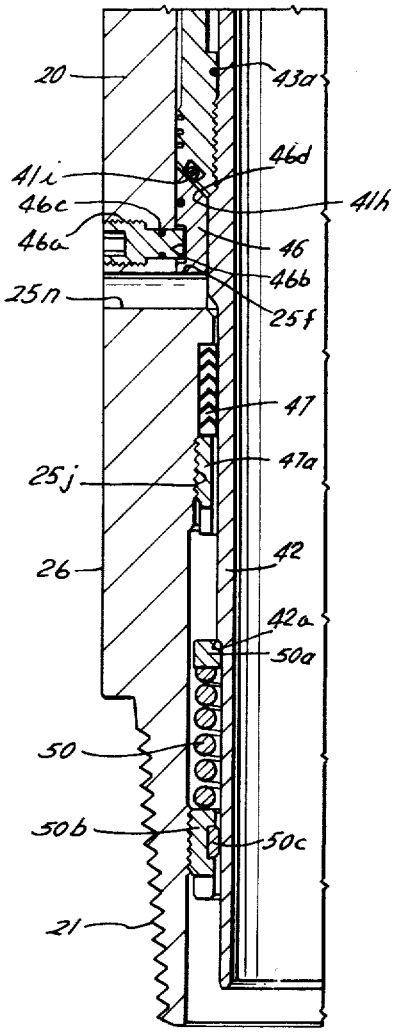

As illustrated in FIG. 2B, the piston means 40 includes a movement lower limit stop means comprising a stop ring 46 located adjacent the shoulder 25*f* of the tubular member 20. The stop ring 46 is secured in the bore 24 by pin member 46*a* threadedly engaged with the tubular member 20 extending within a recess 46*b* of the ring 46. The pin 46*a* is sealed by an O-ring 46*c* with the tubular member 20 to prevent leakage of fluid therebetween. The stop ring 46 has an upwardly facing tapered annular shoulder 46*d* for engaging the sleeve 41 in the lower position. The sleeve 41 has a corresponding downwardly facing tapered annular shoulder 41*h* for engaging the stop ring 46 and which carries an O-ring 41*i* for blocking passage of fluid between the sleeve 41 and the stop 46 when the sleeve 41 is in the lower position.

The lower piston sleeve 42 is sealed to the upper sleeve 41 by an O-ring 43*a* to prevent leakage of fluid therebetween to provide a straight through flow conduit or wash pipe through the lower portion of the well tool 10. The concentric sleeve 42 is sealed to the tubular member 20 by a Chevron packing 47 to prevent leakage of fluid therebetween. The packing 47 is secured in the recess 25*i* by a ring keeper member 47*a* threadedly engaged with the threaded portion 25*j* of the tubular member 20.

As illustrated in FIG. 2B, the well tool 10 includes a means for urging movement of the ball 31 to the closed position when the pressure in the bore 24 exceeds the pressure adjacent the well tool 10 by less than a predetermined value comprising a spring means 50. The spring means 50 is concentrically positioned about the lower portion of piston sleeve 42 for urging the piston means 40 to move upwardly. Urging of the spring 50 is transmitted through a ring keeper member 50*a* to the piston means 40 by engagement of the concentrically mounted keeper 50*a* with the downwardly facing annular shoulder 42*a* of the sleeve 42. The lower end of the spring 50 is mounted with the tubular member 20 by engaging a ring keeper member 50*b* threadedly secured to the tubular member 20 at the threads 25*m*. The lower portion of the sleeve 42 engages a ring member 50*c* mounted with the keeper 50*b* for guiding the longitudinal movement of the sleeve 42 to prevent misalignment and binding of the sleeve 42.

The bore closure means 30 includes a means for spacing the ball 31 from the seat ring 35 prior to commencing to rotate the ball 31 which is mounted on an upwardly facing upper annular shoulder surface 42*b* of the sleeve 42 includes a ring member 36 and an annular shaped longitudinally expanding spring means 37. The ring 36 is positioned above the spring ring 37 to engage the lower spherical surface 31*a* of the ball 31 to impart the upwardly urging of the spring means 37 to the ball 31 to move the ball 31 into sealing engagement with the seat ring 35. When the upwardly urging of the spring 37 is overcome and the spring 37 is compressed the ball 31 is enabled to move downwardly to a spaced position from the seat ring 35.

The concentric arrangement of the piston sleeves 41 and 42 and the tubular member 20 form an annular expansible chamber 48 therebetween for urging the piston means 40 to move upwardly to rotate the ball 31 closed in response to the pressure in the chamber 48. The chamber 48 is located beneath the annular shoulder 41*h* for urging the sleeves 41 and 42 upwardly in response to the pressure adjacent the exterior surface 26 of the tubular member 20 communicated into the chamber 48 through the flow passage 25*n*. The effective surface area of the shoulder surface 41*h* on which the pressure in the chamber 48 urges varies depending upon the position of the piston means. When the piston means is in the upper position (FIG. 1B) the thickness of the annular effective surface area extends from the seal of the chevron packing 47 with the sleeve 42 to the outer edge of the surface 41*h*. When the piston means 40 moves to the lower position the annular effective surface area is reduced by the O-ring 41*i* effecting a seal with the surface 46*d* to block communication of the pressure in the chamber 48 to the outer portion of the surface 41*h*. By increasing the pressure responsive effective surface area for urging the piston means 40 to move upwardly when the piston means 40 commences to move upwardly a snap action movement will be imparted to the piston means 40 to move the ball 31 closed.

The pressure in the bore 24 above the ball 31 for enabling the desired flow down the bore of the drilling string urges downwardly on the piston means 40 on an upwardly facing pressure responsive annular effective surface area formed by the shoulder surface 41*d* of the sleeve 41 extending outwardly from the sealing location of the O-ring 35*b*. When the piston means 40 is in the upper position, the O-ring 41*e* effects a seal with the upper stop ring 45 to block communication to the outer portion of the surface 41*d* which reduces the thickness of the annular effective surface area. The initial downward movement of the piston means 40 breaks the seal and extends the effective surface area to the outer edge of the surface 41*d* to provide an increased urging for imparting an opening snap action to the piston means 40 and the ball 31.

As illustrated in FIG. 1A, the tubular member 20 includes a sleeve member 60 secured therein by the threads 25*a* to form a flow passage through the bore 24. The sleeve 60 is blocked from threadedly disengaging with the tubular member 20 by engagement with a threaded lock pin 61. The lock pin 61 carries an O-ring 61*a* to seal the pin 61 to the tubular member 20 to prevent leakage of fluid therebetween. The sleeve 60 is sealed to the surface 25*b* of the tubular member 20 by an O-ring 60*a* to block passage of fluid therebetween.

A means for releasably locking the bore closure means 30 in the open position in response to a preselected directional pressure in the bore 24 is also included in the drilling tool 10. The means for releasably locking the ball 31 in the open position includes a locking detent means 70, a latch assembly 80, and the annular recess 25*c* in the surface 25*b* of the tubular member 20. The lower portion of the sleeve 60 is stepped by a smaller outer surface constant diameter portion 60*b* to form an annular space between the surface 60*b* and the surface 25*b* of the tubular member 20 for receiving the locking detent means 70 and the latch assembly 80. The sleeve 60 has an annular recess 60*c* formed in the surface 60*b* for carrying an expansible detent ring 62 preventing inadvertant movement of the latch assembly 80. A plurality of downwardly extending flukes 60*d* having openings therebetween are spaced from a port 60*e* for communicating fluid pressure from the bore 24 into the annular space between the surface 60*b* and the surface 25*b* of the tubular member 20.

The detent means 70 includes a movable detent snap ring 71 having a gap therein to enable the ring 71 to expand and contract radially. This enables the ring 71 to move outwardly into the detent receiving annular recess 25*c* when aligned therewith.

The movable latch assembly 80 includes a ring-shaped detent latching member 81 and a latch assembly movement control sleeve 82 concentrically disposed in the bore 24 between the surface 60*b* and the surface 25*b*. The detent latch ring 81 is movable between an upper or released position (FIG. 1) and a lower or locked position (FIG. 3B) in response to a directional pressure in the bore 24 to lock the detent ring 71 in the recess 25*c*. The ring 81 has a plurality of upwardly extending flukes 81*a* for engaging an annular shoulder 60*f* with the sleeve 60 to provide a movement upper limit stop for the ring 81. When the ring 81 is in the upper position the flukes 81*a* are located adjacent port 60*e* in the sleeve 60 for enabling communication of the pressure in the bore 24 to the openings between the flukes 81*a*. The flukes 81*a* are notched at 81*b* for enabling communication among the plurality of fluke openings to communicate the pressure in the bore 24 to the entire upwardly facing annular fluked surface 81*a* for urging the latch member 81 to move downwardly in response to the pressure in the bore 24. The latch member 81 includes a constant diameter outer surface 81*c* having a stepped smaller diameter portion 81*d* adjacent the lower shoulder 81*e* for locking the detent 71 in the recess 25*c*. The ring 81 has a smaller diameter inner surface portion 81*f* positioned adjacent the sleeve 82 for concentrically mounting the sleeve 82 and the ring 81 while enabling relative movement therebetween. The sleeve 81 forms a downwardly facing annular shoulder 81*g* connecting the lower constant diameter surface portion 81*f* when an upper portion 81*h* for providing a pressure urging surface on the sleeve 81. The ring 81 carries an O-ring 81*i* to seal to the surface 60*b* of the fixed sleeve 60 to prevent leakage of fluid between the ring 81 and the sleeve 60. The ring 81 mounts a pair of O-rings 81*j* to seal the outer surface 80*c* of the ring 80 to the surface 25*b* of the tubular member 20 to block passage of fluid therebetween.

Figure 3A:
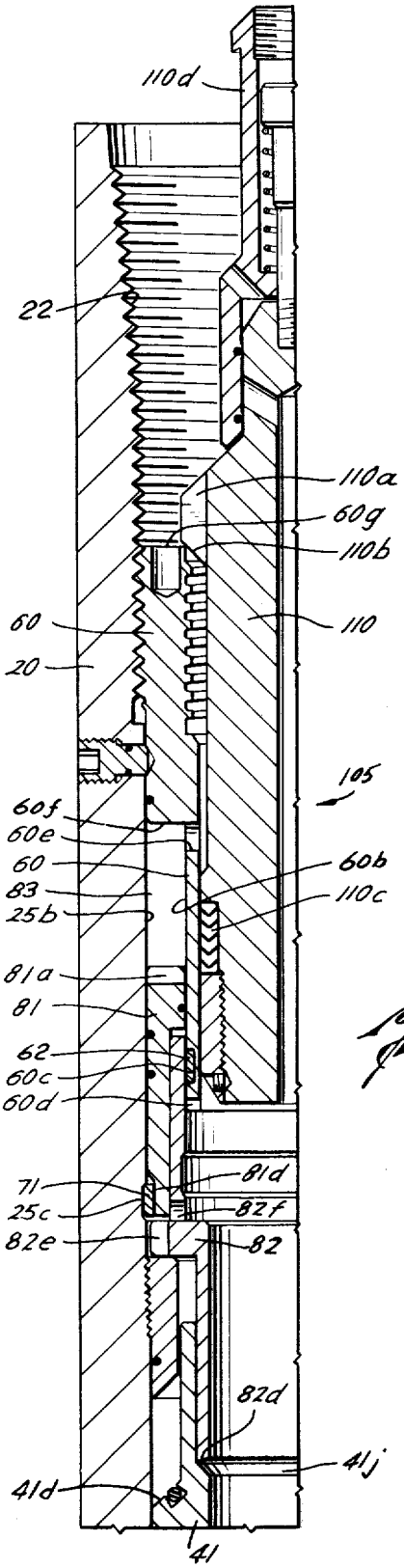
FIGS. 3A and 3B are views, similar to FIGS. 2A and 2B, respectively, illustrating the drilling tool locked open before removal of a locking plug.
Figure 3B:
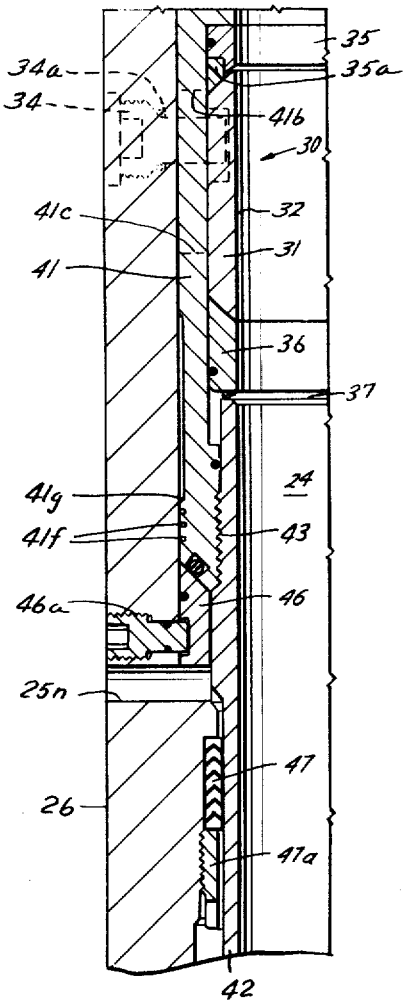

The sealing of O-rings 80*i* and 60*a* forms an expansible or variable capacity chamber 83 communicating with the bore 24 of the tubular member 20 through the port 60*e*. As illustrated in FIG. 3A, the chamber 83 is defined in greater detail by a portion of surface 25*b* of the tubular member 20, the surface 60*b* and 60*f* of the fixed sleeve 60 and the upper fluked surface 81*a* of the ring 81. A preselected directional fluid pressure from the bore 24 communicated through the port 60*e* into the expansible chamber 83 will urge on the upper surface 81*a* of the ring 81 to move the ring 81 downwardly.

The sleeve 82 is longitudinally movable relative to the tubular member 20 between the upper or released position and the lower or locked position. The sleeve 82 has an upper inner larger constant diameter surface portion 82*a* which concentrically mounts the sleeve 82 adjacent the surface 60*b* of the fixed sleeve. The sleeve 82 has an upwardly facing annular shoulder 82*b* which engages the downwardly extending flukes 60*d* of the sleeve 60 to provide a movement limit upper stop for the sleeve 82 while enabling communication of the pressure from the bore 24 through the openings between the flukes 60*d* to the surface 82*a*. The lower inner constant diameter surface portion 82*c* of the sleeve 82 is preferably of at least the same diameter as the bore 32 of the ball 31 to provide a full bore opening through the tool 10. The sleeve 82 has a lower annular shoulder 82*d* which engages an inner annular shoulder 41*j* of the piston sleeve 41 when the sleeve 82 moves downwardly as will be explained. The sleeve 82 has a plurality of radially outwardly extending flukes 82*e* to assist in guiding the longitudinal movement of the sleeve 82 while enabling fluid pressure communication through the openings between the flukes 82*e*. The flukes 82*e* also control the movement of the detent ring 71 to align with the recess 25*c* and engage the locked detent 71 to lock the piston means 40 in the lower position. The sleeve 82 has a port 82*f* formed therethrough immediately above the shoulder 82*b* for enabling communication from the bore 24 through the openings between the flukes 60*d* and through the port 82*f* to the concentric area adjacent the exterior of the sleeve 82. The sleeve 82 has an annular recess 82*g* formed in the upper inner surface 82*a* which aligns with an expansible snap ring 62 located in the recess 60*c* of the sleeve 60 when the sleeve 82 is in the upper position. The movement of the snap ring 62 into the recess 82*g* prevents the sleeve 72 from any inadvertent movement from the upper position.

As illustrated in FIG. 2A, fluid pressure in the bore 24 communicated through the opening between the plurality of flukes 60*d* and through the port 82*f* in the sleeve 82 is communicated into a variable capacity or expansible chamber 84. The fluid pressure in the chamber 84 will urge on the downwardly facing surfaces 81*d*, 81*e* and 81*g* of the ring 81 to urge the ring 81 to move upwardly in response to the pressure in the chamber 84. Because the effective surface areas on which the pressure in the chambers 83 and 84 urge on the latch member 81 are the same size, no movement of the latch 81 will be effected as long as the pressure in the bore 24 is communicated into both the chamber 83 and the chamber 84.

Fluid pressure in the bore 24 communicated through the port 82*f* is also communicated to urge downwardly on the upwardly facing effective surface area of the piston sleeve 41 to urge movement of the piston means 40 downwardly until the shoulder 41*h* engages the shoulder 46*d* of the lower stop ring 46.

As illustrated in FIGS. 3A and 4A, a bridge plug means 105 is included in the means for releasably locking the bore closure means 30 in the open position and is used to control movement of the latch means 70 by controlling communication of pressure in the bore 24 in the predetermined manner through either the port 82*f* or the port 60*e*. The ports 82*h* and 60*e* are spaced a sufficient distance on an inner surface 60*g* of the sleeve 60 to enable the plug means 105 to establish a seal therebetween.

As illustrated in FIG. 3A, the means for releasably locking the ball 31 in the open position includes a locking bridge plug means 110 for communicating a preselected directional pressure into the chamber 83 to urge on the latch ring 81. The locking plug 110 includes a fluted seating collar 110*a* having a lower shoulder surface 110*b* engaging an upwardly facing shoulder 60*g* of the sleeve 60 for positioning the locking plug 110 in the bore 24 of the tubular member 20. The seating collar 110*a* is fluted to enable communication of the pressure in the bore 24 above and below the seating shoulder 110*a*. The locking plug 110 carries an annular packing ring 110*c* to seal the locking plug 110 to the surface 60*g* of the sleeve 60 between the port 60*e* and the fluted portion 60*d* when the seating shoulder 110*b* engages the shoulder 60*h* to block communication of the pressure in the bore 24 above the locking plug 110 to the chamber 84. By pumping or lowering the locking bridge plug 110 down the bore of the drill string to seat within the bore 24 of the drilling tool 10, a subsequent increase in the pressure in the bore of the drill string above the plug 110 will be communicated through the port 60*e* and will be blocked from communicating through the port 82*f* to effect a downward pressure urging on the ring 81. A fishing neck 110*d* secured to the upper portion of the locking plug 110 enables retrieval of the bridge plug 110 from the bore 24 of the drilling tool 10 by a wire line operation after locking the ball 31 open.

Figure 4:
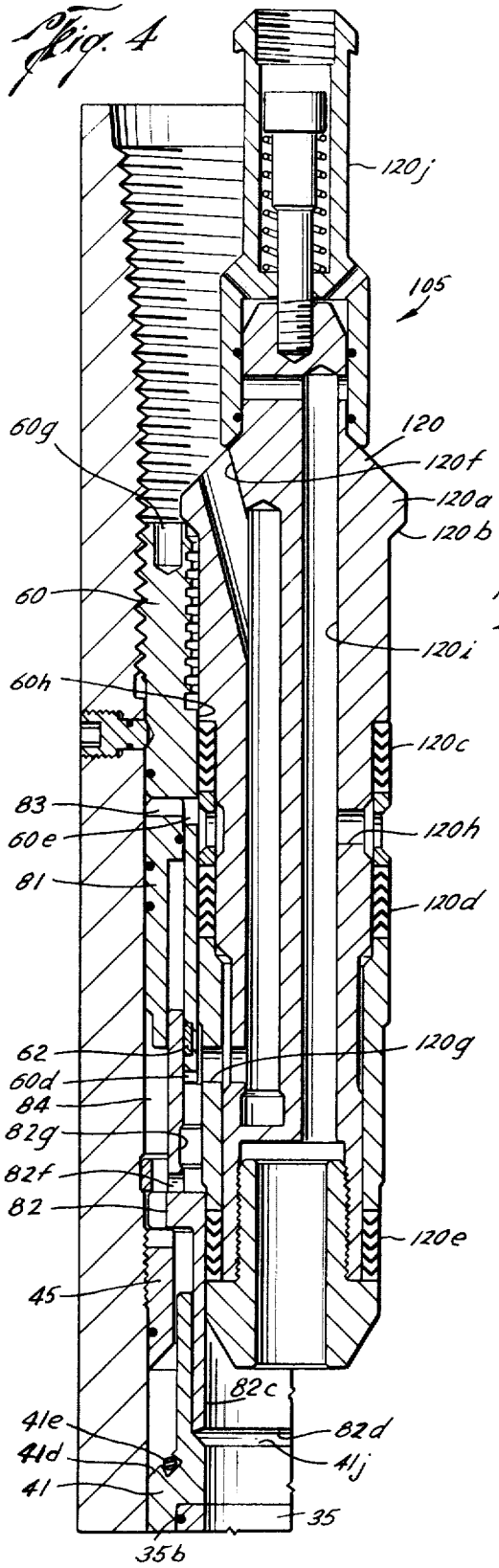
FIG. 4 is a view similar to FIG. 3A, illustrating the drilling tool with an unlocking plug positioned therein prior to unlocking.

The means for releasing the ball 31 from the locked open position includes a cross-over or releasing plug means 120, illustrated in FIG. 4, for communicating a preselected directional pressure to move the latch assembly 80 to release the locking detent 71. The releasing plug 120 is positioned in the bore 24 of the tubular member 20 by lowering the plug 120 down the bore of the drill string. The releasing plug 120 includes an exteriorly extending annular collar 120*a* having a downwardly facing annular seating surface 120*b* for engaging the upwardly facing shoulder 60*g* of the sleeve 60 to block downwardly movement of the plug 120 as well as positioning a plurality of packing or seal rings 120*c*, 120*d* and 120*e* to effect seals in the drilling tool 10. The packing ring 120*c* seals between the releasing plug 120 and the inner surface 60*h* of the sleeve 60 above the port 60*e* while the packing ring 120*d* seals between the locking plug 120 and the sleeve surface 60*h* below the port 60*e* to prevent fluid leakage therebetween. The packing ring 120*e* seals between the plug 120 and the inner surface 82*c* of the sleeve 82 below the port 82*f* to block communication of the fluid pressure from the chamber 84 with the bore 24 below the plug 120. The plug 120 includes a vertical extending channel 120*f* which communicates the pressure in the bore 24 above the plug 120 to a horizontally disposed port 120*g* in the plug 120 communicative with area between the packing rings 120*d* and 120*e*. The fluid pressure between the packing rings 120*d* and 120*e* is communicated through the openings between the flukes 60*d* and through the port 82*f* into the chamber 84 for urging the latch ring 81 to move upwardly to release the detent 71 from the recess 25*c*. The releasing plug has a horizontal port 120*h* located between the packing rings 120*c* and 120*d* communicating with a vertical extending exit channel 120*i* for communicating the chamber 83 and the bore 24 of the tubular member 20 below the unlocking plug 120. The unlocking plug 120 has a fishing neck 120*j* secured to the upper portion of the plug 120 to enable retrieval of the bore plug 120 from the bore 24 of the tubular member 20 by a wire line fishing operation after releasing the ball 31.

Figure 5:
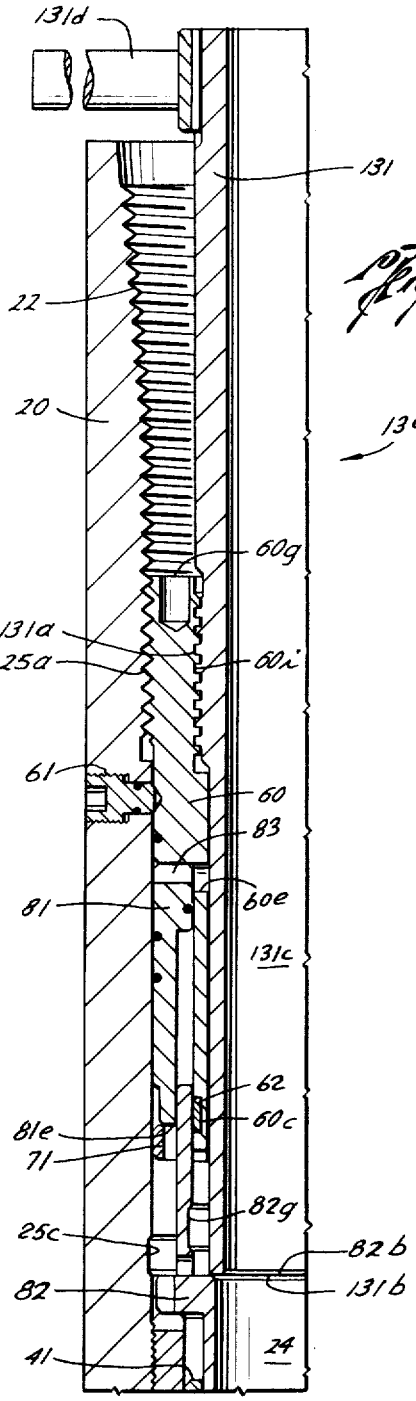
FIG. 5 is a view similar to FIG. 3A, illustrating the drilling tool with a stabbing sleeve installed.

As illustrated in FIG. 5, the tool 10 includes a stabbing means 130 for controlling an undesired flowing stream of fluid from the bore of the drill string by enabling connection of said tubular member with the drill string and thereafter enabling said ball 31 to rotate closed. The stabbing means 130 includes a stabbing sleeve or tubular lock member 131 having a left handed thread 131*a* for engagement with a thread 60*i* on the fixed sleeve 60 to secure the sleeve 131 concentrically in the bore 24 of the tubular member 20. The initial engagement of the threads 60*i* and 131*a* also engages a lower shoulder 131*b* of the tubular member 131 with the annular shoulder 82*b* of the detent sleeve 32 in order that rotation of the sleeve 131 to move the threads 131*a* and 60*f* into complete engagement also moves the sleeve 131 downwardly along with engaged detent sleeve 82 to rotate open the ball 31. The sleeve 131 has a longitudinal bore 131*c* aligned with the bore 24 to enable flow through the bore 131*c* when the sleeve 131 is secured in the tubular member 20.

The use and operation of the present invention provides the driller of a well with flexible protection against inside the drill pipe blowouts during drilling operations previously available only through the use of a plurality of drilling tools. The drilling tool 10 may be connected for automatically controlling the direction of flow in the drill pipe in the drill string at any location, but preferably it is connected a short distance above the drill bit. When lowering the drill string into the well the rotatable ball 31 may be locked open to enable the drilling fluid within the drill hole to flow up the bore of the drill string eliminating the need of filling the bore of the drill string from above the drilling tool 10 to prevent collapse of the drilling string. The rotatable ball valve 31 is then unlocked, as will be explained, prior to commencing drilling operations to enable automatic pressure responsive operation of the drilling tool 10. The driller may, by installing the stabbing sleeve 131, maintain the drilling tool 10 on the rig floor and stab the tool 10 in the drilling string for controlling the flow only after a blowout flow or kick has occcurred.

The drilling tool 10 is in the condition illustrated in FIG. 1A, when connected in the drilling string prior to commencing drilling operations. The piston means 40 is urged upwardly by the spring means 50 to rotate the ball 31 to the closed position. The latch 81, the detent ring 71 and the sleeve 82 are all in the upper position and are held there against inadvertent movement by the snap ring 62. The driller to establish circulation of drilling fluid prior to commencing drilling, will increase the pressure of the drilling fluid supplied to the bore of the drill string by the mud pumps. This pressure will be communicated through the bore of the drill string to the bore 24 of the tubular member 20 above the closed ball 31.

This increased pressure in the bore 24 is communicated through the openings between the flukes **60*d* and the port 82*f* into the expansible chamber 84 and through the port 60*e* into the expansible chamber 83. Because this pressure is urging on equal effective surface areas of the latch member 81 the pressure urgings on the latch member 81 is equal and offsetting and the latch member 81 remains in the position illustrated in FIG. 1A.**

As the pressure of the circulating fluid in the bore 24 above the ball 31 is increased to a pressure greater than the pressure in the bore 24 beneath the ball 31, the pressure urging on the upper surface **31*a* of the ball 31 urges the ball 31 which engages lower ring member 36 to move downwardly when the pressures overcome the upwardly urging of the spring 37. This initial movement spaces the spherical surface 31*a* of the ball 31 from the seating surface 35*a* of the seat ring 35 to prevent scarring or other damage to the ball 31 or seating surface 35*a* when the ball 31 is rotated. This movement also tends to equalize the pressure in the bore 24 urging on the ball 31 before commencing to impart rotation to the ball 31 enabling the longitudinal movement of the ball 31** to be effected by a smaller urging pressure.

The pressure communicated through the port **82*f* is also communicated through the openings between the flukes 32*e* of the sleeve 82 into the lower portion of the expansible chamber 84. This pressure urges downwardly on the piston means 40 on the upwardly facing annular effective surface area of the piston sleeve 41 not sealed by the O-ring 41*e*. The piston sleeve 41 and the detent sleeve 82 are not sealed therebetween, hence there is some communication of fluid pressure where these sleeves adjoin between the expansible chamber 84 and the bore 24.**

The pressure in the bore 24 above the ball 31 when increased sufficiently will urge movement of the ball 31 and the piston means 40 downwardly overcoming the upwardly urging on the piston means 40 of the spring 50 and the well pressure in the chamber 48. As the piston means 40 commences to move downwardly the O-ring **41*e* moves from sealing contact with the shoulder 45*b* to enable the pressure in the bore 24 above the ball 31 to be communicated along the outer surface of the upwardly facing effective surface area of piston means 40 to the labyrinth opening 41*f*. This increases the downwardly urging on the piston means 40 to insure that the piston means 40 moves downwardly and does not flutter or hesitate when moving between the upper and lower positions. As the piston means 40 moves downwardly the expansible chamber 43 below the shoulder 41*h* providing upwardly urging on the piston means 40 by the well annulus pressure is reduced in size. Fluid within the chamber 48 is vented into the well annulus adjacent the exterior surface 26 of the tool 10 through the port 25 *n* in the wall of the tubular member 20. The piston means 40 will continue to move downwardly until the shoulder 41*h* engages the shoulder 46*d* of the lower stop 46 which is sealed therebetween by the O-ring 41*i*. This seal reduces the downwardly facing pressure responsive effective surface area of the piston means 40 for urging the piston means 40** upwardly communicating with the well pressure.

The downwardly movement of the piston means 40 by the pressure in the bore 24 above the ball 31 also moves the ball 31 downwardly. The downward longitudinal movement of the ball 31 relative to the fixed eccentric pins 34 imparts a 90° rotation to the ball 31 to rotate the ball 31 from the closed position (FIG. 1A) to the open position (FIG. 2A). Reference is made to my copending application, Ser. No. 72,034, filed Sept. 14, 1970 now abandoned, which illustrates in greater detail the rotational movement of the ball 31 to and from the open and closed positions upon longitudinal movement of the ball 31 relative to the fixed eccentric pins 34.

The downwardly movement of the piston means 40 to rotate ball 31 open compresses the spring 50 which continues to impart a constant upwardly urging to the piston means 40. By sealing the housing 20 to the sleeve 42 with packing 47, a net upwardly facing pressure responsive surface area on the piston means 40 for the pressure in the bore 24 to urge the piston means 40 to move downwardly in response to the pressure in the bore 24 is provided. This arrangement enables the ball 31 to remain in the open position as long as the pressure in the bore 24 downwardly urging on the effective surface area so formed is greater than the combined upwardly urging of the spring 50 and the well annulus pressure adjacent the exterior of the drilling tool 10 communicated through the channel **25*n* into the expansible chamber 43.**

Should the pressure of the drilling fluid circulated down the bore 24 of the drill string be reduced or the pressure in the annulus of the well communicated through the port **25*n* be increased, such as by a blowout, the ball 31 will be automatically rotated closed to control the flow of fluid through the bore 24. The differential pressure urging on the piston means 40 will be reduced by either occurrence which will enable the urging of the spring 50 to move the piston means 40 upwardly to rotate the ball 31 closed. The upwardly movement of the piston means 40 will engage the ring 36 carried by the sleeve 42 with the ball 31 for moving the ball 31** upwardly. The upwardly movement of the ball 32 relative to the fixed pins 34 extending within the recesses 31*c* will rotate the ball 31 90° from the open position (FIG. 2) to the closed position (FIG. 1). By sensing the incipient pressure changes between the bore 24 and the well annulus the ball 31 will be automatically rotated to the closed position to block upwardly flow of fluid through the bore 24 of the tubular member 20.

When it is desirable to run a well tool through the bore of the drill string or when lowering the drilling string into the well, the ball 31 may be locked open to provide a full bore opening through the tubular member 20. The locking plug 110 is lowered down the bore of the drill string until the shoulder 110*b* seats upon the shoulder 60*g* to position the plug 110 in the tubular member 20. The pressure in the bore of the drill string above the plug 110 is then increased and communicated through the openings between the flukes 110*a* of the locking plug 110 to the port 60*e*. The fluid pressure is communicated through the port 60*e* into the expansible chamber 83 to urge downwardly on the upwardly facing surface 81*a* of the latch 81 for moving the latch 81 downwardly. Use of the plug 110 preselects the direction that the increased pressure will act on the latch ring 81 because the increased pressure in the bore 24 above the plug 110 is also blocked from communicating into the expansible chamber 102 by the packing 110 *c* which eliminates the normal offsetting pressure urging on the latch 81.

The downwardly urging of the pressure in the chamber 83 on the latch ring 81 will move the latch ring 81 downwardly to engage detent 71 with the lower shoulder 81*e* to move the detent 71 and latch 81 downwardly together until the lower shoulder of the detent 71 engages the upper shoulder of the guide flukes 82*e* of the detent sleeve 82. This urging will then force movement of the snap ring 62 from the recess 82*g* into the recess 60*c* to enable the engaged latch 81, detent 71 and sleeve 82 to move downwardly. The downwardly movement of the sleeve 82 engages the shoulder 82*d* with an annular shoulder 41*j* of the piston means 40. The downwardly urging of the pressure in the chamber 83 on the latch 81 will then be used to overcome the upwardly urging of the spring 50 and the well annulus pressure in the chamber 48 to move the latch ring 81, the detent 71, the detent sleeve 82, the piston means 40 and the ball 31 downwardly. The downward movement of the ball 31 relative to the pivot pins 34 will rotate the ball 90° to the open position.

When the ball 31 is rotated open the detent 71 is aligned with the recess 25*c* in the surface 25*b* of the tubular member 20 and will move outwardly into the recess 25*c* enabling the latch ring 81 to move downwardly to the locking position illustrated in FIG. 3A. With the detent 71 locked outwardly into the recess 25*c* by the shoulder 81*d* of the ring 81 a subsequent reduction of the pressure in the chamber 83 will leave the ball 31 locked in the open position. The upper shoulder of the plurality of flukes 82*e* engages the lower shoulder of the detent 71, latched in the recess 25*c* to block upwardly movement of the sleeve 82. The engagement of the shoulder 41*j* of the piston sleeve 41 and the shoulder 82*d* of the locked sleeve 82 blocks upwardly movement of the piston means 40 in response to upwardly urgings thereon. The locking plug 110 may be retrieved from the bore 24 of the drilling tool 10 after locking the ball 31 open by connecting a fishing tool with the fishing neck 110*d* for removing the plug 110. Other well tools may then be run through the bore 24 of the tubular member 20 as desired or the drilling string may be lowered into the well to fill the drilling string with drilling mud in the well.

After completion of the running of the other tools through the bore of the drill string and the tubular member 20, the driller may desire to return the drilling tool 10 to automatic pressure responsive operation. As illustrated in FIG. 4, this is accomplished by dropping or lowering the unlocking plug 120 down the bore of the drill string until the shoulder 120*b* of the unlocking plug 120 is seated on the shoulder 60*g* to position the plug 120 in the bore 24 of the well tool 10. The driller then increases the pressure in the bore of the drill string above the plug 120 which is communicated through the channel 120*f* and the ports 120*g* and 82*f* into the expansible chamber 84. T is increased pressure in the chamber 84 urges upwardly on the downwardly facing portions 81*d*, 81*e* and 81*g* of the latch ring 81 to move the latch 81 upwardly to the position illustrated in FIG. 4. The plug 120 blocks communications of this increased pressure in the bore 24 to the surface 81*a* in the chamber 83 to provide a preselected directional pressure urging on the latch ring 81. Fluid within the expansible chamber 83 is vented by the plug 120 through port 120*h* and channel 120*i* into the bore 24 of the tubular member 20 below the plug 120 to enable upwardly movement of the latch 81 from the detent 71.

The pressure introduced into the expansible chamber 84 by use of the unlocking plug 120 will also urge downwardly on the piston means 40 to maintain the piston means 40 in the lower position and the ball 31 in the open position. When the pressure in the bore of the drill string above the plug 120 is reduced, the spring 50 and the pressure in the chamber 48 will urge the piston means 40 to move upwardly to rotate the ball 31 closed. The engagement of the sleeve 41 of the piston means 40 with the sleeve 82 will force the detent 71 to move out of the recess 25*c* enabling the sleeve 82 and detent 71 to move upwardly until the recess 82*g* aligns with the detent 62 which will then expand outwardly into the recess 32*g* to block subsequent inadvertent movement of the sleeve 32. The unlocking plug 120 is then retrieved from the bore 24 to enable resumption of drilling operations.

Should the driller desire for any reason not to connect the drilling tool 10 in the drill string for automatic operation the tool 10 may still be utilized as an inside blowout preventer. By using the stabbing sleeve 131, illustrated in FIG. 5, the drilling tool 10 may be connected or stabbed in the drill string while an upwardly flow or kick is occurring in the bore of the drill string. To prepare the drilling tool 10 for stabbing, for annular shoulder 131*b* of the sleeve 131 is inserted into the bore 24 at the threaded box 22 end. The mating left handed threads 131*a* of the tubular member 131 and the threads 60*i* of the sleeve 60 are brought into engagement and the tubular sleeve 131 is manually rotated using handles 131*d* to move the sleeve 131 further into the bore 24 of the tubular member 20. As the shoulder 131*b* moves toward the threaded pin end 21 of the tubular member 20 it engages the upwardly facing annular shoulder 82*b* of the sleeve 82 for moving the sleeve 82 downwardly. As the sleeve 131 continues to move into the bore 24, the detent ring 62 is forced inwardly from the recess 82*g* into the recess 60*c* of the sleeve 60 to enable the sleeve 82 to move downwardly. The lower shoulder 82*d* of the sleeve engages the shoulder 41*j* of the piston sleeve 41 to move the ball 31 and the piston means 40 downwardly. As illustrated in FIG. 5, when the threads 60*i* and 130*a* are fully engaged the sleeve 131 has forced the piston means 40 to the lower position to rotate the ball 31 to the open position. The drilling tool 10 is maintained in this condition on the floor of the drilling rig when the tool 10 is to be stabbed into the drilling string.

When an upwardly flow or kick occurs in the bore of the drill string, the drilling tool 10 is ready for stabbing in the drill string. With the ball 31 in the open position, the threaded pin connection 21 may be stabbed into an upper box connection of the drill string. With the full bore opening of the drilling tool 10 provided by the open ball 31 and the sleeve 131, only a minimum amount of interference with the stabbing operation will be caused by the upwardly flowing stream of fluid from the bore of the drill string. When the threaded pin connection 21 is stabbed into and the tool 10 rotated to fully engage with the threaded box connection of the drill string, the handles 131*d* may be used to rotate the tubular member 131 to remove the sleeve 131 from the bore 24 of the drilling tool 10. By making the threads 60*i* and 131*a* a left handed engagement, rotating the tubular member 131 to disengage threads 131*a* and threads 60*i*, the sleeve 60 will not inadvertently disengage from threads 25*a*. Because the fluid pressure in the bore 24 exhausting to the atmosphere above the tool 10 urging downwardly on the piston means 40 is less than the combined upwardly urging of the spring 50 and the atmospheric pressure in the chamber 48, the spring 50 will urge the piston means 40, the ball 31 and the sleeve 82 to move upwardly as the sleeve 131 is removed from the bore 24. The upward movement of the ball 31 rotates the ball about the fixed pins 34 back to the closed position to control the undesired flowing stream of fluid in the bore 24 of the tubular member 20. The ball 31 rotates closed to block the flow prior to disengagement of the threads 60*i* and 130*a* in order that the sleeve 131 will not be blown violently from the bore 24 by the flow. The upwardly movement of the piston means 40 also moves the sleeve 82 upwardly to align the recess 82*g* with the detent 62 to enable the detent 62 to expand outwardly into the recess 82*g* to secure the sleeve 82 against subsequent inadvertent movement.

The foregoing disclosure and description of the invention are illustrative and explanatory thereof, and various changes in the size, shape and materials as well as in the details of the illustrated construction may be made without departing from the spirit of the invention.

I claim:

1. A drilling tool apparatus adapted for connection in a drilling string to control undesired flow through the bore of the drill string including:

a tubular member having a longitudinal bore extending therethrough and means for connection at its upper and lower ends in a drill string with said longitudinal bore in alignment with the bore of the drill string for forming a longitudinal flow passage through said tubular member;

bore closure means movably disposed in said bore of said tubular member for movement to and from an open position for enabling flow of fluid through said longitudinal bore of said tubular member and a closed position for blocking flow of fluid through said longitudinal bore of said tubular member;

means operably connected with said bore closure means for effecting movement of said bore closure means to the open and closed positions, said means including:

piston means forming a longitudinally extending flow passage aligned with said longitudinal bore of said tubular member for providing a longitudinal flow path through the drilling tool and having a first pressure responsive surface exposed to fluid pressure in said bore of said tubular member above said bore closure means for urging on said first pressure responsive surface to effect movement of said piston means in a first direction for moving said bore closure means to the open position to enable flow of fluid through said longitudinal bore;

means sealing with said first pressure responsive surface for increasing the pressure responsive surface area exposed to the fluid pressure as said piston means commences to move in a first direction to move said bore closure means from said closed to said open position for moving said bore closure means in said bore to control flow of fluid through said bore wherein the fluid pressure in said bore effects positive movement of said bore closure means to the open position;

said piston means having a second pressure responsive surface for urging movement of said piston means in a second direction for moving said bore closure means to the closed position;

a flow channel formed in said tubular member and extending from a location on an exterior surface of said tubular member to communicate the pressure adjacent said tubular member with said second pressure responsive surface wherein the pressure adjacent said tubular member urges said piston means to move in the second direction and said bore closure means to move to block flow through said bore of said drill string;

means mounted with said tubular member for urging movement of said piston sleeve in the second direction to move said bore closure means to the closed position to predetermine the pressure in said bore of said tubular member exceeding the pressure adjacent the exterior of said tubular member communicated into said expansible chamber to commence to move said piston means in the first direction; and said piston means carrying said bore closure means when moving in the first direction for effecting movement of said bore closure means relative to said piston means to move said bore closure means to the open position.

2. The apparatus as set forth in claim 1, wherein said bore closure means includes a ball-type valve member having an opening therethrough for rotational movement to and from open and closed positions.

3. The apparatus as set forth in claim 1, including:

means for locking said bore closure means in the open position wherein said bore closure means is rendered inoperative to control flow through the bore of the drill string.

4. The apparatus as set forth in claim 1, wherein:

said piston means includes a piston sleeve movably disposed in said bore of said tubular member and having a first pressure response surface area exposed to fluid pressure in said bore for urging movement of said piston sleeve in a first direction to operate said bore closure means to the open position in response to the urging of the pressure in said bore for enabling the desired flow.

5. The apparatus as set forth in claim 4, wherein:

said piston sleeve and said tubular member form an expansible chamber therebetween;

said second pressure responsive surface for urging movement of said piston means in the second direction to operate said bore closure means to the closed position in response to the pressure in said expansible chamber, and a flow channel formed in said tubular member and extending from a location on an exterior surface of said tubular member to communicate the pressure adjacent said tubular member with said expansible chamber wherein the pressure adjacent said tubular member urges said bore closure means to move to block flow through said bore of said drill string.

6. The apparatus as set forth in claim 5, wherein:

said bore closure means includes a rotatable ball-type valve member having an opening therethrough for movement to and from the open position aligning said opening with said bore and the closed position with said opening positioned for enabling said ball-type valve member to block flow through said bore when said piston sleeve member moves in response to the urgings thereon.

7. The apparatus as set forth in claim 1, wherein:

said bore closure means having a ball-type valve member and an upper seat means mounted concentrically above the valve member and engageable with the valve member for blocking passage of fluid around said valve member.

8. The apparatus as set forth in claim 7, wherein:

said bore closure means having a means for urging said valve member into engagement with said upper seat means.

9. The apparatus as set forth in claim 8, wherein:

said urging means being movable relative to the upper seat means to provide spacing of said valve member from engagement with said upper seat means when said urging means on said bore closure means is overcome.

10. The apparatus as set forth in claim 1, wherein:

said second pressure responsive surface includes means sealing with said second pressure responsive surface for increasing the pressure responsive surface area exposed to the fluid as said piston means commences to move in said second direction to move said bore closure means from said open to said closed position for moving said bore closure means in said bore to control flow of fluid through said bore wherein the fluid pressure adjacent said tubular member effects positive movement of said bore closure means to the closed position.

11. A drilling tool apparatus adapted for connection in a drilling string to control undesired flow through the bore of the drill string including:

a tubular member having a bore therethrough and adapted for connection at its upper and lower ends in a drill string with said bore communicating with the bore of the drill string for forming a flow passage through said tubular member;

bore closure means disposed in said bore of said tubular member for movement to and from an open position for enabling flow of fluid through said bore of said tubular member and a closed position for blocking flow of fluid through said bore of said tubular member;

means operably connected with said bore closure means for urging movement of said bore closure means to the open and closed positions said means including:

piston means having a pressure responsive surface exposed to fluid pressure for urging on said pressure responsive surface to effect movement of said piston means for moving said bore closure means to control flow of fluid through said bore;

means sealing with said pressure responsive surface for increasing the pressure responsive surface area exposed to the fluid pressure as said piston means commences to move for moving said bore closure means to control flow of fluid through said bore wherein the fluid pressure effects positive movement of said bore closure means to the other position to control the flow; and stabbing means removably mounted with said tubular member for controlling an undesired flowing stream of fluid through the bore of the drilling string by enabling connection of said tubular member with the drilling string with said bore closure means maintained in the open position to form a full bore opening bore flow path and thereafter enabling said bore closure means to move to the closed position by removing said stabbling means from said tubular member wherein the undesired flowing stream is controlled.

12. A drilling tool adapted for connection in a drill string to control undesired flow through the bore of the drill string including:

a tubular member having a bore therethrough and adapted for connection at its upper and lower ends in a drill string with said bore in alignment with the bore of the drill string;

bore closure means movably disposed in said bore of said tubular member for movement to and from an open position enabling flow of fluid through said bore of said tubular member and to and from a closed position blocking flow of fluid through said bore of said tubular member;

piston means operably connected with said bore closure means for urging movement of said bore closure means to the open position when the pressure in said bore for enabling the desired flow exceeds the pressure adjacent said tubular member by a predetermined value;

said piston means includes a piston sleeve movably disposed in said bore of said tubular member and having a first pressure response surface area for urging movement of said piston sleeve in a first direction to operate said bore closure means to the open position when the pressure in said bore for enabling the desired flow exceeds the pressure adjacent said tubular member;

said piston sleeve and said tubular member form an expansible chamber therebetween;

said piston sleeve having a second pressure responsive surface for urging movement of said piston means in a second direction to operate said bore closure means to the closed position in response to the pressure in said expansible chamber;

a flow channel formed in said tubular member and extending from a location on an exterior surface of said tubular member to communicate the pressure adjacent said tubular member with said expansible chamber;

means mounted with said tubular member for urging movement of said piston sleeve in the second direction to move said bore closure means to the closed position when the pressure adjacent the exterior of said tubular member communicated into said expansible chamber by less than the predetermined pressure;

said bore closure means includes a ball-type valve member operably connected with said piston sleeve and having an opening therethrough for rotational movement to and from the open and closed positions when said piston sleeve member moves in response to the urgings thereon;

a seat ring mounted for movement with said piston sleeve and having a sealing surface engaging said ball member for blocking flow of fluid between said ball and said seat ring when said ball is in the open and closed positions; and means for spacing said ball member from said sealing surface of said seat ring prior to commencing to effect rotation of said ball member to the open position wherein the spacing movement of said ball member protects said sealing surface from wear.

13. A drilling tool adapted for connection in a drill string to control undesired flow through the bore of the drill string including:

a tubular member having a longitudinal bore extending therethrough and means for connection at its upper and lower ends in a drill string with said longitudinal bore in alignment with the bore of the drill string;

bore closure means movably disposed in said bore of said tubular member for movement to and from an open position enabling flow of fluid through said longitudinal bore of said tubular member and to and from a closed position blocking flow of fluid through said bore of said tubular member;

piston means operably connected with said bore closure means for urging movement of said bore closure means to the open position when the pressure in said bore for enabling the desired flow exceeds the pressure adjacent said tubular member by a predetermined value;

said piston means includes a piston sleeve movably disposed in said bore of said tubular member and having a first pressure responsive annular surface area for urging movement of said piston sleeve in a first direction to operate said bore closure means to the open position when the pressure in said bore for enabling the desired flow exceeds the pressure adjacent said tubular member;

said piston sleeve and said tubular member form an expansible chamber therebetween;

said piston sleeve having a second pressure responsive annular surface for urging movement of said piston means in a second direction to operate said bore closure means to the closed position in response to the pressure in said expansible chamber;

a flow channel formed in said tubular member and extending from a location on an exterior surface of said tubular member to communicate the pressure adjacent said tubular member with said expansible chamber;

means mounted with said tubular member for urging movement of said piston sleeve in the second direction to move said bore closure means to the closed position when the pressure in said bore of said tubular member exceeds the pressure adjacent the exterior of said tubular member communicated into said expansible chamber by less than the predetermined pressure;

said bore closure means includes a ball-type valve member operably connected with said piston sleeve and having an opening therethrough for rotational movement relative to said piston sleeve to and from the open and closed positions when said piston sleeve member moves in response to the urgings thereon;

said ball member moves along the longitudinal axis of said bore of said tubular member when rotating to and from the open and closed positions;

means sealing with said pressure responsive surface for increasing the first pressure responsive surface area exposed to the fluid pressure in said bore as said piston means commences to move for moving said bore closure means to the open position to enable flow of fluid through said bore wherein the fluid pressure effects positive movement of said bore closure means to the open position to control the flow;

said piston sleeve concentrically positioned in said bore of said tubular member between said ball member and said tubular member; and means operably connecting said ball member with said piston sleeve for providing relative movement of said bore closure means to said piston means when said piston sleeve moves in the first direction.

14. A drilling tool adapted for connection in a drill string to control undesired flow through the bore of the drill string including:

a tubular member having a bore therethrough and adapted for connection at its upper and lower ends in a drill string with said bore in alignment with the bore of the drill string;

bore closure means movably disposed in said bore of said tubular member for movement to and from an open position enabling flow of fluid through said bore of said tubular member and to and from a closed position blocking flow of fluid through said bore of said tubular member;

piston means operably connected with said bore closure means for urging movement of said bore closure means to the open position when the pressure in said bore for enabling the desired flow exceeds the pressure adjacent said tubular member by a predetermined value;

said piston means includes a piston sleeve movably disposed in said bore of said tubular member and having a first pressure responsive surface area for urging movement of said piston sleeve in a first direction to operate said bore closure means to the open position when the pressure in said bore for enabling the desired flow exceeds the pressure adjacent said tubular member;

said piston sleeve and said tubular member form an expansible chamber therebetween;

said piston sleeves having a second pressure responsive surface for urging movement of said piston means in a second direction to operate said bore closure means to the closed position in response to the pressure in said expansible chamber;

a flow channel formed in said tubular member and extending from a location on an exterior surface of said tubular member to communicate the pressure adjacent said tubular member with said expansible chamber;

means mounted with said tubular member for urging movement of said piston sleeve in the second direction to move said bore closure means to the closed position when the pressure in said bore of said tubular member exceeds the pressure adjacent the exterior of said tubular member communicated into said expansible chamber by less than the predetermined pressure; and means movably mounted with said tubular member for releasably locking said bore closure means in the open position by operating movement of said releasable locking means actuated by the direct application of fluid pressure in a predetermined manner to effect locking or releasing movement wherein said bore closure means is releasably rendered inoperative to control flow through the bore of the drill string.

15. The apparatus as set forth in claim 14, wherein said means for releasably locking said bore closure means in the open position includes:

a. said bore of said tubular member defining a surface having a recess therein;

b. a latch assembly movably disposed in said bore of said tubular member for movement when a preselected directional pressure urges thereon to and from a released position enabling pressure responsive movement of said bore closure means and to and from a locking position for blocking movement of said bore closure means from the open position to the closed position; and c. a detent member movably mounted with said latch device and adapted to move into said recess when said latch device is in the locking position, said detent member latched in said recess by said latch assembly to secure said latch assembly in the locking position when the preselected directional pressure for locking said bore closure is reduced wherein said bore closure means is rendered inoperative to control flow through the bore of the drill string.

16. The apparatus as set forth in claim 15, wherein said latch assembly includes:

a. a detent latching member having a first pressure responsive surface area for urging said latch assembly to the locking position in response to the preselected directional pressure urging thereon and a second pressure responsive surface area for urging said detent latching member to release said detent from said recess in response to the preselected directional pressure urging thereon;

b. a latch assembly movement control sleeve movably disposed in said bore of said tubular member for forming a first expansible chamber therebetween for providing pressure urging to said first pressure responsive surface of said detent latching member through a first passageway formed in said sleeve to communicate the pressure in said bore of said tubular member with said first pressure responsive surface, said sleeve and said tubular member forming a second expansible chamber therebetween for providing pressure urging to said second pressure responsive surface of said detent latching member through a second passageway formed in said sleeve to communicate the pressure in said bore of said tubular member with said second pressure responsive surface for normally providing equal pressure urging on said detent latching member; and c. said first passageway and said second passageway spaced a sufficient distance to receive a plug means therebetween to control the directional pressure urging on said latch device wherein the operating movements of said latch device are effected.

17. A drilling tool adapted for connection in a drill string to control undesired flow through the bore of the drill string including:

a tubular member having a bore therethrough and adapted for connection at its upper and lower ends in a drill string with said bore in alignment with the bore of the drill string;

bore closure means movably disposed in said bore of said tubular member for movement to and from an open position enabling flow of fluid through said bore of said tubular member and to and from a closed position blocking flow of fluid through said bore of said tubular member;

piston means operably connected with said bore closure means for urging movement of said bore closure means to the open position when the pressure in said bore for enabling the desired flow exceeds the pressure adjacent said tubular member by a predetermined value;

said piston means includes a piston sleeve movably disposed in said bore of said tubular member and having a first pressure responsive surface area for urging movement of said piston sleeve in a first direction to operate said bore closure means to the open position when the pressure in said bore for enabling the desired flow exceeds the pressure adjacent said tubular member;

said piston sleeve and said tubular member form an expansible chamber therebetween;

said piston sleeve having a second pressure responsive surface for urging movement of said piston means in a second direction to operate said bore closure means to the closed position in response to the pressure in said expansible chamber;

a flow channel formed in said tubular member and extending from a location on an exterior surface of said tubular member to communicate the pressure adjacent said tubular member with said expansible chamber;

means mounted with said tubular member for urging movement of said piston sleeve in the second direction to move said bore closure means to the closed position when the pressure in said bore of said tubular member exceeds the pressure adjacent the exterior of said tubular member communicated into said expansible chamber by less than the predetermined pressure; and stabbing means for moving said piston sleeve to overcome said urging means for controlling an undesired flowing stream of fluid from the bore of the drilling string by enabling connection of said tubular member with the drilling string with said bore closure means maintained in the full open position to form a full opening flow path and thereafter enabling said bore closure means to move to the closed position wherein the undesired flowing stream of fluid is controlled.

18. The apparatus as set forth in claim 17, wherein said stabbing means includes a stabbing member removably secured in said bore of said tubular member for engaging said piston sleeve to maintain said bore closure means in the open position, said bore closure means moving to the closed position when the stabbing member is removed from said bore wherein the undesired flowing stream of fluid is controlled.

* * * * *